US010711330B2

(12) United States Patent
Guo et al.

(10) Patent No.: US 10,711,330 B2
(45) Date of Patent: Jul. 14, 2020

(54) CORROSION-RESISTANT MAGNESIUM-ALUMINUM ALLOYS INCLUDING GERMANIUM

(71) Applicant: GM GLOBAL TECHNOLOGY OPERATIONS LLC, Detroit, MI (US)

(72) Inventors: Yang Guo, Shanghai (CN); Ming Liu, Shanghai (CN); Anil K. Sachdev, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 308 days.

(21) Appl. No.: 15/792,440

(22) Filed: Oct. 24, 2017

(65) Prior Publication Data

US 2019/0119793 A1 Apr. 25, 2019

(51) Int. Cl.
*C22C 23/02* (2006.01)

(52) U.S. Cl.
CPC ..... *C22C 23/02* (2013.01)

(58) Field of Classification Search
None
See application file for complete search history.

(56) References Cited

U.S. PATENT DOCUMENTS 4,675,157 A * 6/1987 Das ..... B22F 9/008 420/405
5,158,621 A * 10/1992 Das ..... B23K 35/28 148/528
5,273,569 A * 12/1993 Gilman ..... C22C 1/1084 148/420
6,264,762 B1 7/2001 Bommer et al.
2008/0317621 A1* 12/2008 Aoki ..... C22C 1/02 420/402
2012/0313230 A1* 12/2012 Mengel ..... H01L 24/29 257/676
2017/0036307 A1* 2/2017 Pan ..... H01L 23/49811

FOREIGN PATENT DOCUMENTS

CN 102839308 A 12/2012
CN 104046870 A 9/2014
CN 102978494 B 6/2015

OTHER PUBLICATIONS

Keir, D.S. et al., "The Influence of Ternary Alloying Additions on the Galvanic Behavior of Aluminum-Tin Alloys", J. of the Electrochemical Society, vol. 116, No. 3, pp. 319-322, Mar. 1969.*
Murray, G.T. et al., "Preparation and Characterization of Pure Metals", ASM Handbook, vol. 2: Properties and Selection: Nonferrous Alloys and Special-Purpose Metals, pp. 1093-1097, ASM international, 1990.*

* cited by examiner

*Primary Examiner* — George Wyszomierski

(57) ABSTRACT

Magnesium-aluminum corrosion-resistant alloys are provided and include magnesium, aluminum, germanium, small amounts of cathodic reaction active site impurities such as iron, copper, nickel, and cobalt, manganese, and optionally tin. The alloy can include up to about 0.75% germanium, at least about 2.5% aluminum, up to about 2.25% tin, at most 0.0055% iron impurities, and at most 0.125% silicon impurities. The ratio of germanium to iron can be less than 150. The ratio of manganese to iron can be at least 75. The alloy can comprise one or more intermetallic complexes, including magnesium-germanium, magnesium-aluminum, and aluminum-manganese intermetallic complexes.

20 Claims, 1 Drawing Sheet

CORROSION-RESISTANT MAGNESIUM-ALUMINUM ALLOYS INCLUDING GERMANIUM

INTRODUCTION

Magnesium is a lightweight, high-strength element used in a variety of applications and industries such as automotive, aerospace, and the like. For example, incorporating magnesium parts into automobiles can improve fuel efficiency. However, magnesium and its alloys are susceptible to corrosion. Corrosion can be inhibited by applying conversion coatings, such as chromium-based coatings, to the surfaces of magnesium-based articles, or anodizing the same surfaces. However, physical damage to such articles diminishes anti-corrosive benefits proximate the damage location.

SUMMARY

A corrosion resistant magnesium-aluminum alloy is provided. The alloy can include at most 0.75 wt. % germanium, tin, aluminum, and the balance including magnesium. The alloy can include at least 2.5 wt. % aluminum. The alloy can include less than 0.125 wt. % silicon impurities. The alloy can include at most 2.25 wt. % tin. The alloy can include less than 0.0055 wt. % iron impurities. The alloy can further include manganese, and the ratio of manganese to iron can be at least 75.

A corrosion resistant magnesium-aluminum alloy is provided. The alloy can include germanium, tin, aluminum, at most 0.125 wt. % silicon impurities, and the balance including magnesium. The alloy can include at least 2.5 wt. % aluminum. The alloy can include less than 0.0055 wt. % iron impurities. The alloy can include at most 2.25 wt. % tin. The alloy can include at most 0.75 wt. % germanium. The alloy can further include one or more magnesium-germanium intermetallic complexes. The alloy can further include one or more magnesium-aluminum intermetallic complexes and/or one or more aluminum-manganese intermetallic complexes.

A corrosion resistant magnesium-aluminum alloy is provided. The alloy can include at most 0.75% germanium, at least 3.5 wt. % aluminum, iron impurities, and the balance including magnesium. The ratio of germanium to iron can be less than 150. The alloy can include at most 2.25 wt. % tin. The alloy can include less than 0.0055 wt. % iron impurities. The alloy can further include tin. The alloy can further include manganese, and the ratio of manganese to iron can be at least 75. The alloy can further include one or more aluminum-manganese intermetallic complexes. The alloy can further include one or more magnesium-aluminum intermetallic complexes.

Other objects, advantages and novel features of the exemplary embodiments will become more apparent from the following detailed description of exemplary embodiments and the accompanying drawings.

DETAILED DESCRIPTION

Figure 1A:
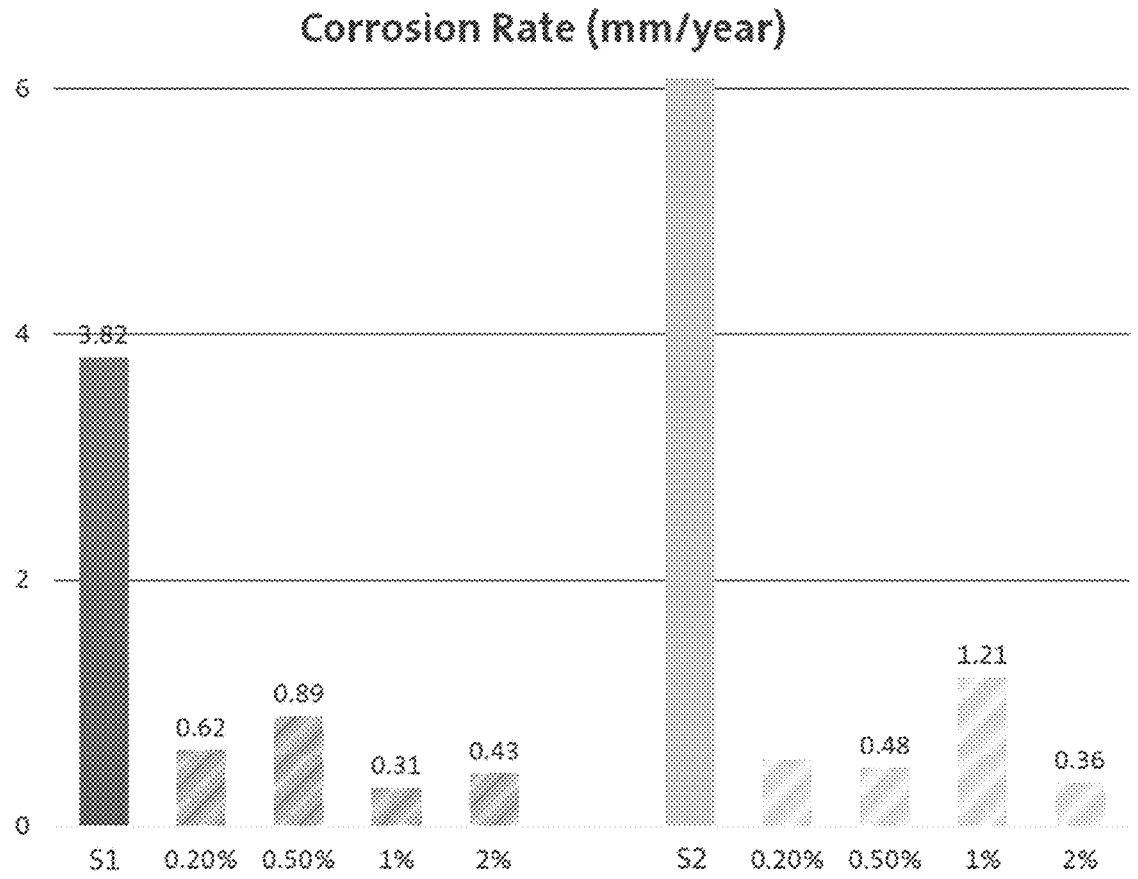
FIG. 1A illustrates anti-corrosion properties of several magnesium-aluminum alloys, according to one or more embodiments.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Magnesium-based compositions can corrode when exposed to aqueous environments. Corrosion proceeds through a cathodic reaction, such as by the corrosion reaction for water contacting a magnesium substrate shown in Equation (1):

$$Mg+2H_2O \rightarrow Mg(OH)_2+H_{2(g)} \quad (1)$$

The anodic half-reaction can proceed as shown in Equation (2):

$$Mg+Mg^{2+} \rightarrow 2e^- \quad (2)$$

The cathodic half-reaction can proceed as shown in Equation (3):

$$H^+ + e^- \rightarrow H_{(ad)} \quad (3)$$

According to the cathodic half-reaction, Equation (3), adsorbed hydrogen species ($H_{(ad)}$) populate active sites of a magnesium substrate. Gaseous diatomic hydrogen ($H_2$) can subsequently evolve when two adsorbed hydrogen species occupy sufficiently proximate active sites.

Provided herein are magnesium-aluminum alloys which exhibit kinetically hindered corrosion attributes through the inclusion of germanium and optionally tin. While the corrosion-inhibiting attributes of the alloys provided herein are not intended to be limited to a particular chemical or physical mechanism, germanium and optionally tin prevent, eliminate, or otherwise inhibit corrosion by sequestering cathodic reaction active sites. Cathodic reaction active sites can comprise iron impurities, which can occur in magnesium-aluminum alloys as bulk precipitates. Cathodic reaction active sites can further comprise copper, nickel, and cobalt impurities. Germanium and optionally tin have been found to preferentially migrate to iron impurities during alloying, and, moreover, selectively accumulate on the surface of iron impurities rather than throughout the precipitate bulk. Accordingly, germanium and optionally tin may be utilized in spare quantities to sequester iron impurities and allow higher magnitude inclusion of desired structural metals (e.g., magnesium, aluminum, zinc). Some magnesium-aluminum alloys provided herein further exhibit physically hindered corrosion attributes through the inclusion of manganese and intermetallic complexes thereof.

Generally, corrosion resistant magnesium-aluminum alloys (hereafter "alloys") described herein comprise magnesium, aluminum, germanium, manganese, and optionally tin. Alloy compositions will be defined as a percentage (by weight) of one or more alloying elements or compounds (e.g., aluminum, germanium, etc.) with the balance of the alloy comprising magnesium, substantially comprising magnesium. The magnesium content of the alloys may vary based on the content of other elements and compounds present in the alloys, but is generally at least about 75%. Magnesium can be present in its elemental form within the alloys, and can additionally optionally be present as one or more compounds, such as magnesium-germanium intermetallic complexes. Magnesium-germanium intermetallic complexes can comprise $Mg_2Ge$, among others. Intermetallic $Mg_2Ge$ has a hexagonal close packed (HCP) lattice structure as contrasted to the cubic lattice structure of elemental germanium. The ratio of intermetallic germanium to elemental germanium can be dependent on factors such as alloy composition and alloy cooling rate, but the ratio of intermetallic germanium to elemental germanium is generally greater than 1. The alloys can further comprise impurities. In many embodiments, alloys comprise iron impurities.

The alloys comprise aluminum in varying amounts generally greater than about 2%. Aluminum can enhance strength, wear resistance, hardness, and castability of alloys. Alloys configured for high strength can comprise greater than 6%, greater than 6.5%, or greater than 7.5% aluminum, for example. Alloys configured for creep resistance can comprise about 2.75% to about 6.25%, or about 3% to about 6% aluminum, for example. Alloys configured for high formability can comprise about 1.75% to about 4.25%, or about 2% to about 4% aluminum, for example. Aluminum can be present in its elemental form within the alloys, and can additionally optionally be present as one or more compounds, such as one or more magnesium-aluminum intermetallic complexes. Magnesium-aluminum intermetallic complexes can comprise $Mg_{17}Al_{12}$ and $Al_8Mg_5$, among others. Intermetallic complexes $Mg_{17}Al_{12}$ and $Al_8Mg_5$ have cubic lattice structures. The ratio of intermetallic aluminum to elemental aluminum can be dependent on factors such as alloy composition and alloy cooling rate, but the ratio of intermetallic aluminum to elemental aluminum is generally greater than 1. In some embodiments the majority of aluminum is present as the $Mg_{17}Al_{12}$ intermetallic complex. The morphology of magnesium-aluminum intermetallic complexes can vary within the bulk alloy based on one or more factors such as cooling rate. For example, lamellar network structures can be observed at grain boundaries when one or more alloys described herein are processed via high pressure die casting (HPDC), as contrasted with bulk discontinued phases observed at grain bounders for alloys processed using gravity casting.

The alloys comprise germanium in varying amounts, but most preferably no greater than about 0.75%. Generally the alloys will comprise at least about 0.05%, or at least about 0.075% germanium, and the alloys can comprise up to about 0.75% germanium. In one or more embodiments, the alloys can comprise up to about 0.5%, up to about 0.4%, or up to about 0.3% germanium. In one or more embodiments, the alloys can comprise about 0.05% to about 0.35%, about 0.075% to about 0.325%, or about 0.1% to about 0.3% germanium. In a particular embodiment, the alloys comprise about 0.05% to about 0.35% germanium. The germanium content of the alloys can be defined in relation to the iron impurity content of the alloys. In order to maximize corrosion resistance, it is desired for germanium to be present in sufficient amounts such that the outer surfaces of bulk iron precipitates comprise germanium. Properly limiting germanium content below levels at which corrosion resistance is not enhanced or substantially enhanced allows structural elements (e.g., magnesium, aluminum) to be included in higher quantities. For example, the alloys can comprise a germanium to iron ratio of up to about 150, up to about 100, up to about 75, or up to about 60, in some embodiments. In some embodiments, the alloys can comprise a germanium to iron ratio of up to about 75, up to about 70, up to about 65, or up to about 60. The ratio of germanium to iron is at least about 15 in most embodiments. In some embodiments, the ratio of germanium to iron is about 10 to about 100, about 15 to about 75, or about 20 to about 60. The alloys in some embodiments can be characterized by a selective positioning of germanium and optionally tin proximate to iron impurities.

The alloys can optionally, in addition to germanium, comprise tin in varying amounts. Generally, such alloys comprise at least about 0.25%, or at least about 0.4% tin, and the alloys can comprise up to about 3% tin. In one or more embodiments, the alloys can comprise up to about 3%, up to about 2.5%, or up to about 2% germanium. In one or more embodiments, the alloys can comprise about 0.25% to about 0.35%, about 0.4% to about 3%, or about 2.5% to about 2% tin. In a particular embodiment, the alloys comprise about 0.25% to about 0.35% tin.

The alloys can optionally comprise zinc in varying amounts generally up to about 3%. Zinc can improve strength when combined with aluminum. Alloys configured for high strength can comprise about 0.25% to about 2.35%, or about 0.5% to about 2% zinc. Zinc can be present in its elemental form within the alloys, and, in some embodiments, can optionally selectively migrate to the one or more intermetallic complexes described herein.

In some embodiments, the alloy can further comprise manganese. Generally, such alloys comprise at least about 0.1%, or at least about 0.15% manganese, and the alloys can comprise up to about 1% manganese. In one or more embodiments, the alloys can comprise up to about 0.8%, up to about 0.7%, or up to about 0.6% manganese. In one or more embodiments, the alloys can comprise about 0.1% to about 0.7%, about 0.15% to about 0.65%, or about 0.2% to about 0.6% germanium. Alloys including manganese can comprise about 0.1% manganese to about 0.65% manganese, about 0.15% manganese to about 0.625% manganese, or about 0.2% manganese to about 0.6% manganese. In some embodiments, manganese is present m its elemental form. Additionally or alternatively, manganese is present as one or more compounds. Manganese can be present as one or more aluminum-manganese intermetallic complexes. Aluminum-manganese intermetallic complexes can comprise $Al_8Mn_5$. Intermetallic gamma-$Al_8Mn_5$ has a rhombohedral lattice structure, for example, as contrasted to the cubic lattice structure of elemental manganese. The ratio of intermetallic manganese to elemental manganese can be dependent on factors such as alloy composition and alloy cooling rate, but the ratio of intermetallic manganese to elemental manganese is generally greater than 1. Aluminum-manganese intermetallic complexes can provide a physical anti-corrosion benefit to the alloys by forming around and physically encapsulating cathodic reaction active site impurities such as iron, copper, nickel, and cobalt. In some embodiments, the alloys can be characterized by a selective positioning of aluminum-manganese intermetallic complexes proximate to, and optionally encapsulating, cathodic reaction active site impurities. In some embodiments, the manganese content of the alloys can be defined in relation to the iron impurity content of the alloys. For example, the alloys can comprise a manganese to iron ratio of at least about 75, or at least about 100.

The alloys can comprise cathodic reaction active site impurities such as iron, copper, nickel, and cobalt. The alloys can comprise at most about 0.0045%, at most about 0.005%, or at most about 0.0055% iron. The alloys can comprise at most about 0.005%, at most about 0.01%, or at most about 0.015% copper. The alloys can comprise at most about 0.0005%, at most about 0.001%, or at most about 0.0015% nickel. The alloys can comprise at most about 0.0005%, at most about 0.001%, or at most about 0.0015% cobalt. In one embodiment, the alloys can comprise at most about 0.01%, at most about 0.0171, or at most about 0.025% total cathodic reaction active site impurities.

In some embodiments, the alloys can comprise structural impurities such as silicon. Silicon can detrimentally impact desired mechanical properties of the alloys when present in undesired quantities. For example, the formation of $Mg_2Si$ near grain boundaries decreases the ductility of the alloys. In some embodiments, the alloys can comprise at most about 0.075%, at most about 0.1%, or at most about 0.125% silicon. In some embodiments, structural impurities additionally or alternatively comprise calcium. Calcium can frustrate the casting of magnesium alloys, for example by causing hot tears (i.e., cracking) during cooling. In some embodiments, the alloys comprise at most about 0.075%, at most about 0.1%, or at most about 0.125% calcium. In some embodiments, the alloys comprise at most about 0.15%, at most about 0.2%, or at most about 0.25% total structural impurities.

The alloys can further comprise a superficial fluoride-containing anti-corrosion layer. Such fluoride-containing anti-corrosion layers and methods for applying the same to magnesium alloys are described in co-owned. U.S. patent application Ser. No. 15/690,329, the contents of which are herein incorporated in their entirety.

In a particular embodiment, a magnesium-aluminum alloy can comprise at most 0.75% germanium, at most 2.25% tin, at least about 2.5% aluminum, at most 0.0055% a iron impurities, and the balance magnesium. The alloy can optionally include manganese, and the ratio of manganese to iron can be at least 75.

In a particular embodiment, a magnesium-aluminum alloy can comprise at most 0.75% germanium, at most 2.25% tin, at least about 2.5% aluminum, at most 0.125% silicon impurities, at most 0.0055% iron impurities, and the balance magnesium. The alloy can optionally include manganese, and the ratio of manganese to iron can be at least 75. The alloy can comprise one or more magnesium-germanium intermetallic complexes. The alloy can comprise one or more magnesium-aluminum intermetallic complexes and/or one or more aluminum-manganese intermetallic complexes.

In a particular embodiment, a magnesium-aluminum alloy can comprise at most 0.75% germanium, at least about 3.5% aluminum, at most 0.0055% iron impurities, and the balance magnesium. The ratio of germanium to iron can be less than 150. The alloy can optionally include at most 2.25 wt. % tin. The alloy can optionally include manganese, and the ratio of manganese to iron can be at least 75. The alloy can comprise one or more magnesium-germanium intermetallic complexes. The alloy can comprise one or more magnesium-aluminum intermetallic complexes and/or one or more aluminum-manganese intermetallic complexes.

Example 1

Figure 1B:
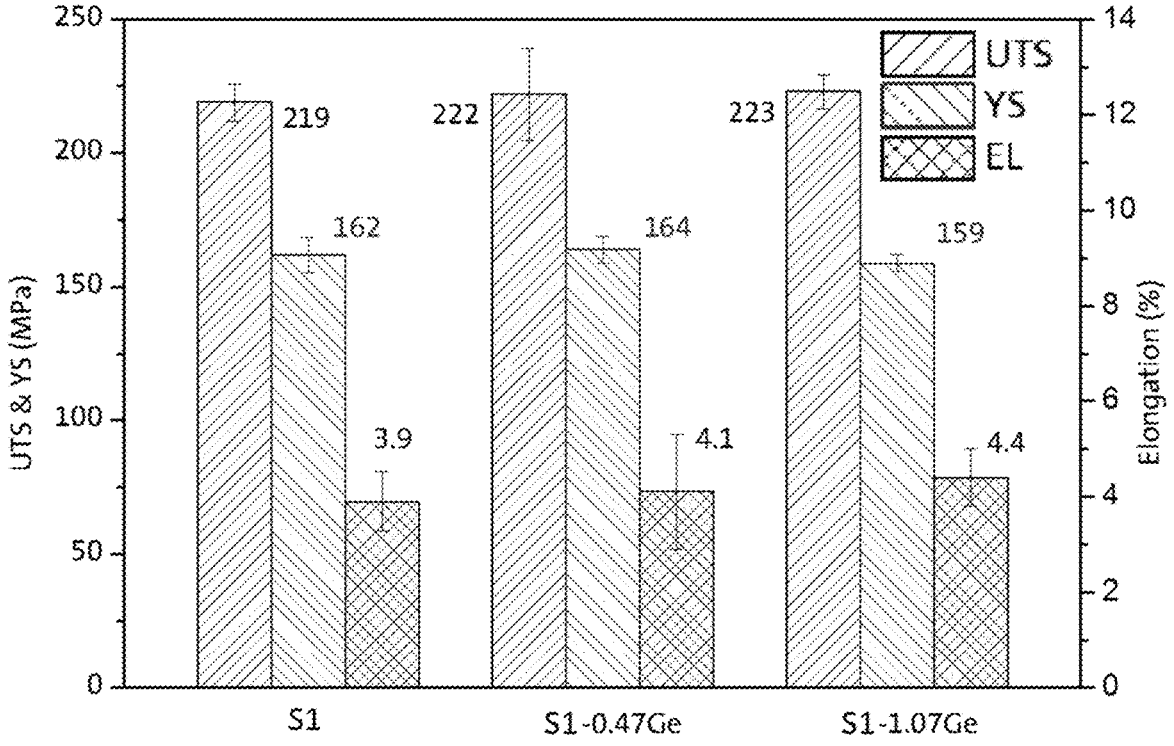
FIG. 1B illustrates structural properties of several magnesium-aluminum alloys, according to one or more embodiments

A first sample (S1) comprised 7.5-10% aluminum, 0.5-2.0% zinc, 0.2-0.5% manganese, less than 0.10% silicon impurities, less than 0.01 copper impurities, less than 0.001 nickel impurities, less than 0.005% iron impurities and the balance magnesium. A second sample (S2) comprised 4.0-7.5% aluminum, less than 0.25% zinc, 0.2-0.6% manganese, less than 0.10% silicon impurities, less than 0.01 copper impurities, less than 0.001 nickel impurities, less than 0.005% iron impurities and the balance magnesium. Each of the samples S1 and S2 were each modified to include 0.2% germanium, 0.5% germanium, 1% germanium, and 2% germanium in discrete variations. S1, S2, and the respective variations thereof were analyzed for corrosion resistance, and the results are shown in FIG. 1A. The samples were corrosion-tested through immersion in a 0.1M NaCl solution. The results for variants of S1 and S2 indicate that increased corrosion resistance does not vary linearly with germanium content. S1 was also modified to include 0.47% germanium and 1.07% germanium in discrete variations; all three samples were analyzed to determine ultimate tensile strength (UTS), yield strength (YS), and elongation (EL) and the results are shown in FIG. 1B. The results show that the 0.47% germanium sample has a higher UTS increase to germanium content ratio than the 1.07% germanium sample. The results also show that the 0.47% germanium sample has a higher yield strength relative to SI, but the 1.07% germanium sample has a lower yield strength relative to the 0.47% germanium sample.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A magnesium aluminum alloy, comprising:
0.05 wt. % to 0.75 wt. % germanium,
7.5 wt. % to 10 wt. % aluminum,
0.5 wt. % to 2.0 wt. % zinc,
0.2 wt. % to 0.5 wt. % manganese,
optionally one or more impurities, wherein the impurities comprise:
at most 0.125 wt. % silicon,
at most 0.015 wt. % copper,
at most 0.0015 wt. % cobalt,
at most 0.0015 wt. % nickel, and
at most 0.0055 wt. % iron, and
the balance comprising magnesium.

2. The alloy of claim 1, wherein the alloy further comprises at most 2.25 wt. % tin.

3. The alloy of claim 1, wherein the ratio of intermetallic germanium to elemental germanium is greater than 1.

4. The alloy of claim 1, wherein the alloy is gravity-cast.

5. A magnesium aluminum alloy, comprising:
0.05 wt. % to 0.75 wt. % germanium,
up to about 3 wt. % tin,
7.5 wt. % to 10 wt. % aluminum,
0.5 wt. % to 2.0 wt. % zinc,
0.2 wt. % to 0.5 wt. % manganese,
optionally one or more impurities, wherein the impurities comprise:
at most 0.125 wt. % silicon,
at most 0.015 wt. % copper,
at most 0.0015 wt. % cobalt,
at most 0.0015 wt. % nickel, and
at most 0.0055 wt. % iron, and
the balance comprising magnesium.

6. The alloy of claim 5, wherein the alloy comprises at most 2.25 wt. % tin.

7. The alloy of claim 5, wherein the alloy further comprises one or more magnesium-germanium intermetallic complexes, one or more magnesium-aluminum intermetallic complexes, and/or one or more aluminum-manganese intermetallic complexes.

8. The alloy of claim 7, wherein the magnesium-germanium intermetallic complexes comprise $Mg_2Ge$ intermetallic complexes, the magnesium-aluminum intermetallic complexes comprise $Mg_{17}Al_{12}$ and/or $Al_8Mg_5$ intermetallic complexes, and the aluminum-manganese intermetallic complexes comprise $Al_8Mn_5$ intermetallic complexes.

9. The alloy of claim 5, wherein the ratio of intermetallic germanium to elemental germanium is greater than 1.

10. The alloy of claim 5, wherein the alloy is gravity-cast.

11. A magnesium aluminum alloy, comprising:
0.05 wt. % to 0.75 wt. % germanium,
7.5 wt. % to 10 wt. % aluminum,
0.5 wt. % to 2.0 wt. % zinc,
0.2 wt. % to 0.5 wt. % manganese,
iron impurities, and
the balance comprising magnesium;
wherein the ratio of germanium to iron is less than 150.

12. The alloy of claim 11, wherein the alloy comprises at most 2.25 wt. % tin.

13. The alloy of claim 11, wherein the alloy further comprises up to about 3 wt. % tin.

14. The alloy of claim 11, wherein the ratio of manganese to iron is at least 75.

15. The alloy of claim 11, wherein the alloy further comprises one or more aluminum-manganese intermetallic complexes.

16. The alloy of claim 15, wherein the one or more aluminum-manganese intermetallic complexes comprise $Al_8Mn_5$ intermetallic complexes.

17. The alloy of claim 11, wherein the alloy further comprises one or more magnesium-aluminum intermetallic complexes.

18. The alloy of claim 17, wherein the one or more magnesium-aluminum intermetallic complexes comprise $Mg_{17}Al_{12}$ and/or $Al_8Mg_5$ intermetallic complexes.

19. The alloy of claim 11, wherein the alloy further comprises one or more magnesium-germanium intermetallic complexes.

20. The alloy of claim 19, wherein the one or more magnesium-germanium intermetallic complexes comprise $Mg_2Ge$ intermetallic complexes.

* * * * *